US008147028B2

(12) United States Patent
Ito

(10) Patent No.: US 8,147,028 B2
(45) Date of Patent: Apr. 3, 2012

(54) NOZZLE INSPECTING DEVICE IN FLUID DISCHARGE APPARATUS, FLUID DISCHARGE APPARATUS, AND NOZZLE INSPECTION METHOD

(75) Inventor: Keigo Ito, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 518 days.

(21) Appl. No.: 12/391,970

(22) Filed: Feb. 24, 2009

(65) Prior Publication Data

US 2009/0213168 A1 Aug. 27, 2009

(30) Foreign Application Priority Data

Feb. 25, 2008 (JP) ..... 2008-042521

(51) Int. Cl.
*B41J 2/165* (2006.01)
*B41J 29/393* (2006.01)

(52) U.S. Cl. ..... 347/23; 347/5; 347/19; 347/20; 347/22; 347/29; 347/30; 347/31; 347/32; 347/33

(58) Field of Classification Search ..... 347/23, 347/29, 32
See application file for complete search history.

(56) References Cited

U.S. PATENT DOCUMENTS

| | | | | |
|---|---|---|---|---|
| 6,536,865 | B2 * | 3/2003 | Sarmast | 347/23 |
| 2003/0160838 | A1 * | 8/2003 | Su et al. | 347/19 |
| 2007/0076029 | A1 * | 4/2007 | Komatsu | 347/9 |
| 2007/0134969 | A1 * | 6/2007 | Endo et al. | 439/341 |
| 2007/0188538 | A1 * | 8/2007 | Izuo | 347/19 |
| 2008/0180482 | A1 * | 7/2008 | Shimazaki | 347/23 |
| 2008/0180483 | A1 * | 7/2008 | Shimazaki | 347/23 |
| 2008/0192085 | A1 * | 8/2008 | Shimazaki | 347/35 |

FOREIGN PATENT DOCUMENTS

| | | |
|---|---|---|
| JP | 59-178256 | 10/1984 |
| JP | 2002-079693 | 3/2002 |

* cited by examiner

*Primary Examiner* — Ryan Lepisto
(74) *Attorney, Agent, or Firm* — Workman Nydegger

(57) ABSTRACT

A nozzle inspection device includes an inspection electrode placed apart from a discharge unit with a gap therebetween, an inspection unit for inspecting the presence of a defective nozzle by discharging a fluid with respect to the inspection electrode in a state in which the electric field is generated by application of a voltage between the discharge unit and the inspection electrode, a detection unit for detecting whether the inspection unit is in a non-inspectable state, and a gap adjustment unit for adjusting the gap by transferring either the discharge unit or the inspection electrode in a case in which the inspection unit is in the non-inspectable state.

5 Claims, 12 Drawing Sheets

NOZZLE INSPECTING DEVICE IN FLUID DISCHARGE APPARATUS, FLUID DISCHARGE APPARATUS, AND NOZZLE INSPECTION METHOD

BACKGROUND

1. Technical Field

The present invention relates to a nozzle inspection device in a fluid discharge apparatus which inspects presence of a defective nozzle which becomes incapable of discharging the requisite amount of fluid due to nozzle clogging of a discharge unit by discharging fluid from nozzles, a fluid discharge apparatus, and a nozzle inspection method.

2. Related Art

From the past, in an ink jet printer which is a kind of the fluid discharge apparatus, printing to a target, such as paper, is performed by discharging ink from nozzles of a recording head (discharge unit). If ink in the nozzles was thickened or air bubbles invaded into the ink, the defective nozzle which cannot discharge the requisite amount of ink arose, bringing about the dead pixel in a print image.

Accordingly, a nozzle inspection device which inspects presence of this kind of defective nozzles is disclosed. Therefore, according to JP-A-59-178256 and JP-A-2002-79693, when the nozzle inspection device detects the defective nozzle, a cleaning comes to be performed with respect to the nozzles of a recording head.

For example, in the nozzle inspection device (nozzle clogging detection device) disclosed in JP-A-59-178256, the recording head (ink jet head) serves as a first electrode, a second electrode is disposed at a side wall facing the recording head in a nozzle covering hole of a capping member, and a voltage is applied between the first and second electrodes by a power supply. In such a state, charged ink droplets are ejected from the recording head, and an electric field detection portion which detects a change of an intensity of an electric field between the first and second electrodes which is attributable to the passing of the ink droplets is disposed.

JP-A-2002-79693 discloses a laser nozzle inspection device which inspects presence of the defective nozzle by detecting light interception of laser light, emitted toward an ink traveling pathway, which is attributable to the ink droplets discharged from the nozzles. JP-A-2002-79693 further discloses a nozzle inspection device using a vibrating plate inspection method for inspecting the dead pixel by checking presence of a vibration of a vibrating plate which is attributable to the ink droplets when the ink droplets are discharged to the vibrating plate.

SUMMARY

An advantage of some aspects of the invention is that it provides a nozzle inspection device in a fluid discharge apparatus, a fluid discharge apparatus, and a nozzle inspection method which can ensure required inspection precision regardless of an attached state of fluid or a fouling, such as a dry matter of fluid to an inspection electrode.

According to one aspect of the invention, there is provided a nozzle inspection device for inspecting presence of a defective nozzle in a fluid discharge apparatus including a discharge unit having nozzles which can discharge fluid to a target, including an inspection electrode placed apart from the discharge unit with a gap therebetween, an inspection unit for inspecting the presence of the defective nozzle on the basis of a detection value obtained by detecting a change of an intensity of an electric field which is attributable to a discharge of the fluid by discharging the fluid with respect to the inspection electrode from the discharge unit in a state in which the electric field is generated by applying a voltage between the discharge unit and the inspection electrode, a detection unit for detecting whether the inspection unit is in a non-inspectiable state, and a gap adjustment unit for adjusting the gap by transferring either the discharge unit or the inspection electrode in a case in which the inspection unit is in the non-inspectable state, in which the inspection unit inspects presence of the defective nozzle at least after performing gap adjustment by using the gap adjustment unit. In the case of inspecting a plurality of nozzles, it is sufficient that at least a portion of a nozzle inspection is performed after gap adjustment.

According to this aspect, when the detection unit detects that the inspection unit is in the non-inspectable state which is set such that the requisite inspection precision cannot be obtained, the gap adjustment unit adjusts a gap between the discharge unit and the inspection electrode to be a width by which the inspection unit can transit to the inspectable state by transferring at least one of the discharge unit and the inspection electrode. After the gap adjustment, the inspection unit inspects the presence of the defective nozzle on the basis of the detection value obtained by detecting the change of an intensity of an electric field between the discharge unit and the inspection electrode which is attributable to the discharge of the fluid while fluid is discharged to the inspection electrode from the discharge unit. With such a structure, it is possible to ensure the required inspection precision regardless of the attached state of the fluid or the fouling such as the dry matter of the fluid to the inspection electrode.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
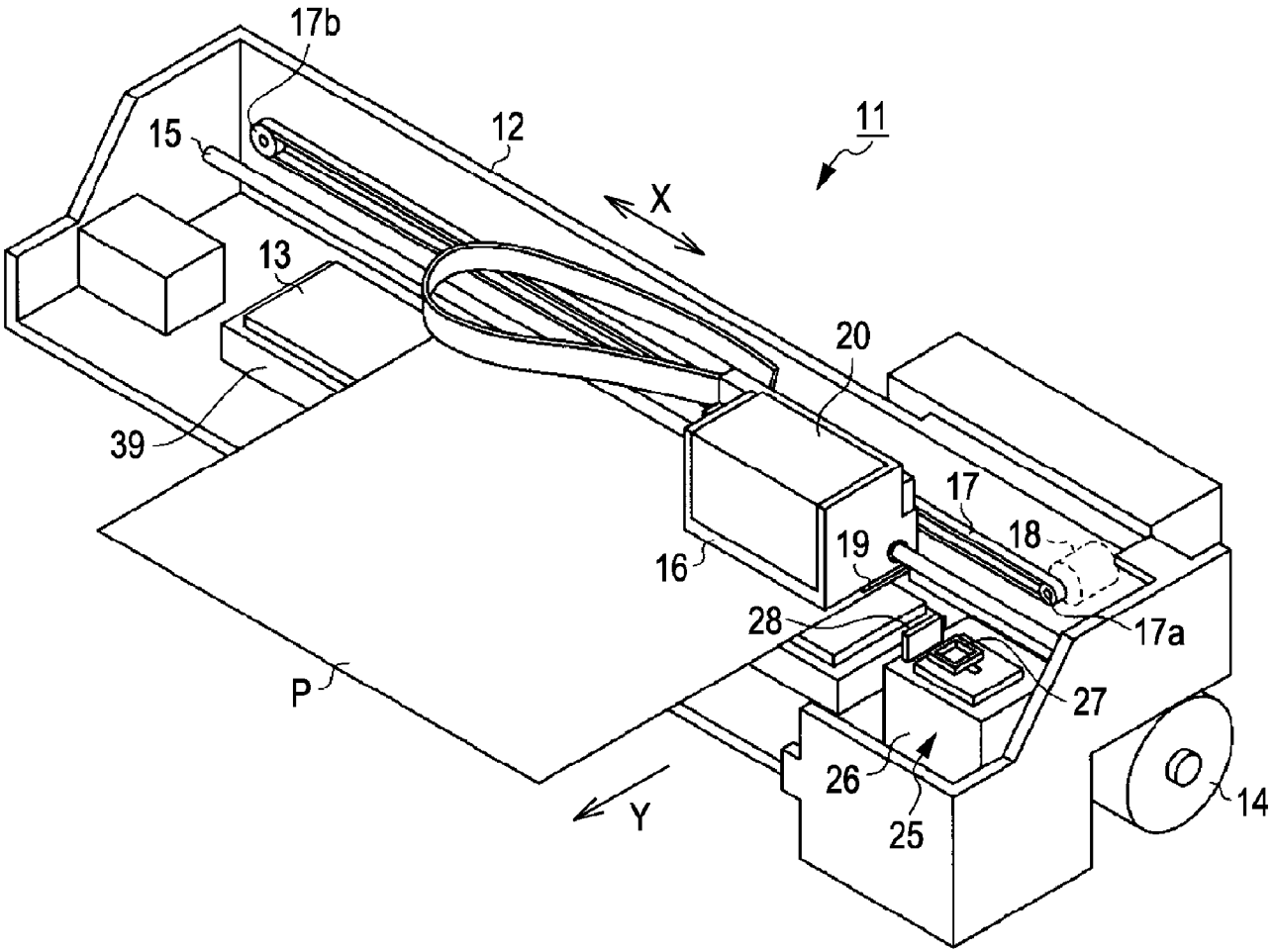
FIG. 1 is a schematic perspective view illustrating a printer according to one embodiment of the invention.

One embodiment of the invention will be described with reference to FIGS. 1 through 8. FIG. 1 is a perspective view illustrating an ink jet-type printer from which an outer casing is taken off.

As shown in FIG. 1, the ink jet-type printer (hereinafter, referred to as "printer 11") serving as a fluid discharge apparatus includes a main body frame 12 which is in a substantially rectangular box shape. A platen 13 is disposed at a lower portion of the main body frame 12 so as to extend along a longitudinal direction of the main body frame 12. On the platen 13, paper P is disposed in a manner such that the paper P is supplied from a rear side thereof by a paper transporting mechanism (not shown) by virtue of driving of a paper transporting motor (hereinafter, referred to as "PF motor 14") disposed at a lower portion of a rear surface of the main body frame 12.

On the platen 13 in the main body frame 12, a guide shaft 15 is installed in the longitudinal direction of the platen 13. A carriage 16 is supported in the guide shaft 15 in a manner such that the carriage can freely reciprocate in a shaft line direction of the guide shaft 15. A drive pulley 17*a* and a driven pulley 17*b* are supported in a freely pivotable manner at positions corresponding to both ends of the guide shaft 15 in a rear wall inside surface of the main body frame 12. The drive pulley 17*a* is connected to an output shaft of a carriage motor (hereinafter, referred to as "CR motor 18") which is a drive source for enabling the carriage 16 to reciprocate and an endless type timing belt 17 connected to the carriage 16 is installed between the pair of pulleys 17*a* and 17*b*. Accordingly, the carriage 16 is able to be transferred in a primary scan direction via the endless timing belt 17 by virtue of the drive power of the CR motor 18 while it is guided by the guide shaft 15.

The underside of the carriage 16 is provided with a recording head 19 and the upside of the carriage 16 is provided with ink cartridges 20 in which a plural kinds of ink (fluid) is stored and which is detachably installed.

Figure 5:
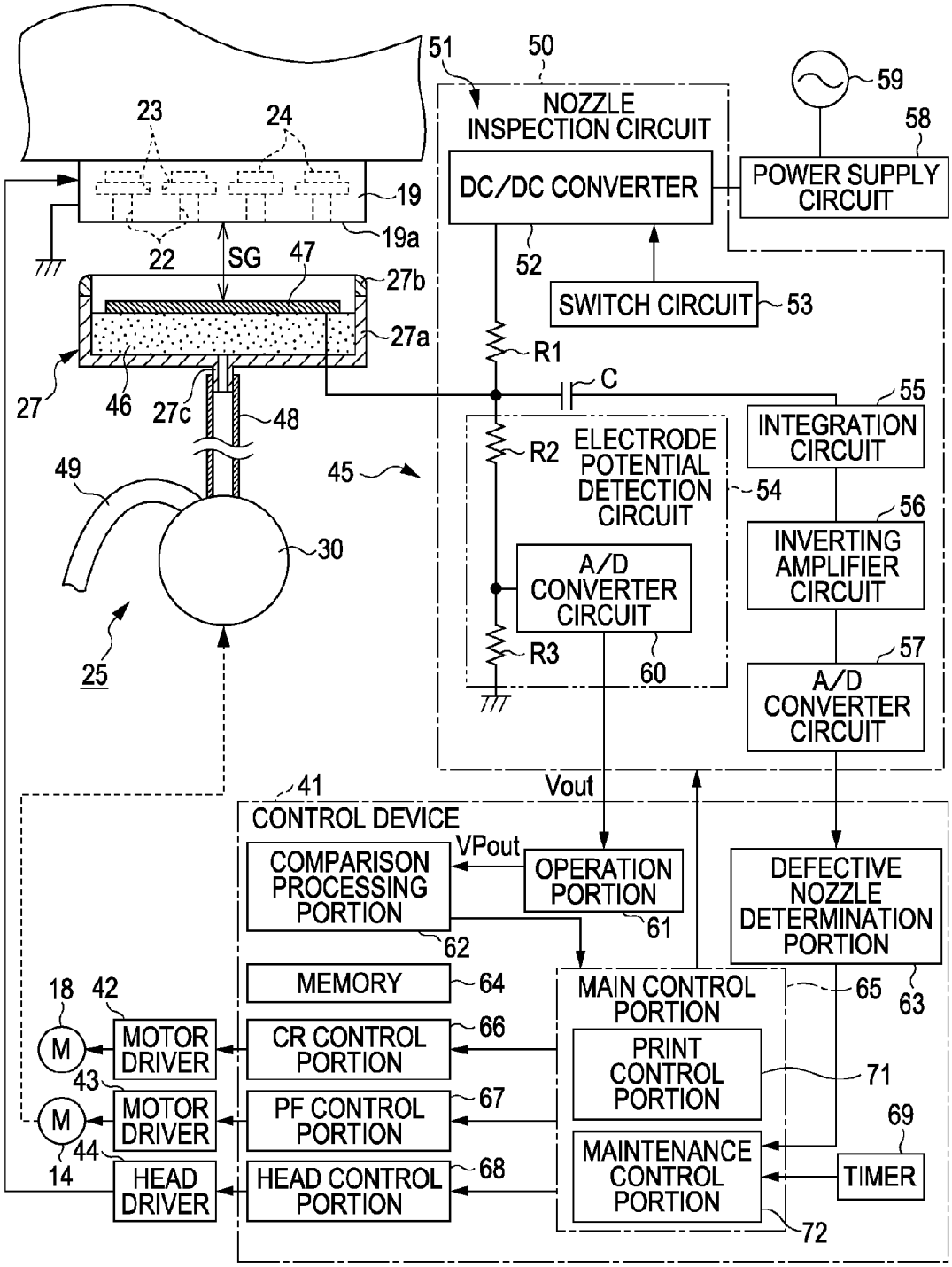
FIG. 5 is a block diagram illustrating an electric configuration of a printer equipped with a nozzle inspection device.

Further, the underside of the recording head 19 is a nozzle orifice surface 19*a* (nozzle forming surface) at which a plurality of nozzles 22 is open (FIG. 5 shows only four nozzles). The nozzle orifice surface 19*a* is provided with a plural number of nozzle columns according to kinds of ink (for example four nozzle columns corresponding to 4 kinds of ink including cyan, magenta, yellow, and black) in which each of the nozzle column includes a plural number of nozzles (for example, 180 nozzles) arranged at regular pitches. The number of nozzle columns is the same as the number of kinds of ink. Each nozzle 22 is linked with the inside of the ink cartridge 20 via the carriage 16 and an ink supply path 23 (see FIG. 5) formed in the recording head 19.

The ink supplied to the recording head 19 from the ink cartridge 20 via the ink supply path 23 is ejected (discharged) from the nozzles 22 as discharge drive elements 24 (shown in FIG. 5) disposed so as to correspond to the nozzles 22 of the recording head 19 are driven. The discharge drive elements 24 are selected according to a discharge method of the recording head 19. For example, when the discharge method is a piezoelectric method, the discharge drive element 24 may be a piezoelectric element. On the other hand, in the case in which the discharge method is an electrostatic method, the discharge drive element may be an electrostatic drive element. Further, in the case in which the discharge method is a method of discharging ink droplets by pressure of air bubbles when ink film-boils, the discharge drive element may be a heater for heating ink.

As shown in FIG. 1, a right end position on a carriage transfer path which is a non-print area, to which the paper P is not supplied, in the main body frame 12 is a home position at which the carriage 16 stands by while the printer 11 stops to print. A maintenance device 25 performing cleaning for preventing and eliminating nozzle-clogging of the recording head 19 is disposed directly beneath the carriage 16 when the carriage 16 is placed at the home position.

Figure 2:
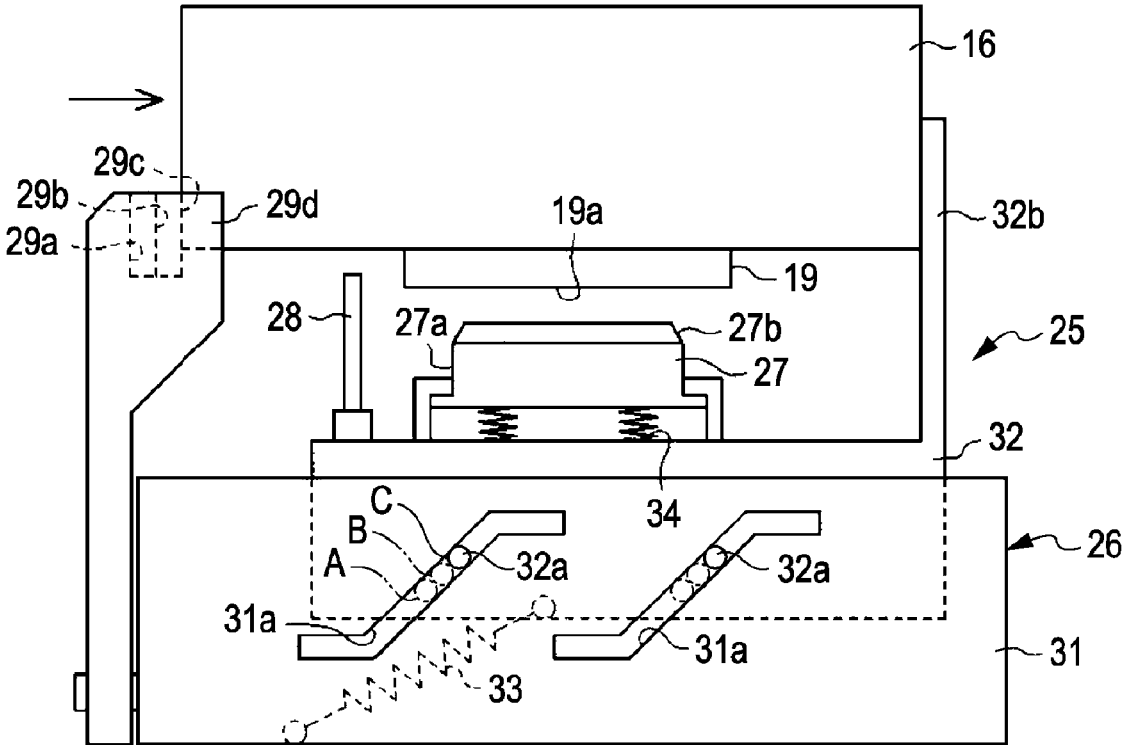
FIG. 2 is a schematic side view illustrating a maintenance device.

FIG. 2 is a schematic side view illustrating the maintenance device. As shown in FIG. 2, the maintenance device 25 includes an elevating and lowering mechanism 26, a cap 27, a wiper 28, a locking lever 29, and a suction pump 30 (see FIG. 5). The elevating and lowering mechanism 26 includes a housing 31 which is placed on the bottom surface of a main body frame 12 and is open at an upper portion thereof, a slider 32 attached to the housing 31 in a manner such that the slider 32 can be moved in an inclined direction, that is, the slider 32 can be moved in a primary scan direction and a vertical direction, and an urging spring 33 which urges the slider 32 in a direction from the home position to the print area. The print area means an area in which the carriage 16 moves in the middle of printing processing.

The slider 32 includes four guide pins 32*a* in which two guide pins 32*a* (FIG. 2 shows only two guide pins at only one surface) are disposed at each of a pair of side surfaces (two surfaces facing paper surfaces in an orthogonal direction in FIG. 2, FIG. 2 shows only one side surface). The guide pins 32*a* engage with a pair of guide holes 31*a* which are formed to penetrate at the housing 31 through the inclined paths extending to the primary scan direction and the vertical direction. At least one engagement portion 32*b*, which serves as a manipulation portion, which is in a rod form, can engage with the carriage 16, and has a predetermined length, protrudes in an upward direction from the right end upper portion of the slider 32 of FIG. 2.

The cap 27 is positioned at a predetermined height on the slider 32 in a state in which the cap is urged upward by the spring 34. For example, the cap 27 is adapted to be pressed against the nozzle orifice surface 19*a* by the urging force of the spring 34 when the cap 27 is elevated and is brought into contact with the nozzle orifice surface 19*a*. The wiper 28 formed in a rectangular plate form and made of an elastic material, such as synthetic rubber, is placed at a position near the print area with respect to the cap 27 on the slider 32. The wiper 28 is installed so as to be able to wipe a predetermined area of the nozzle orifice surface 19*a*, including the entire nozzles.

When the carriage 16 reaches the engagement portion 32*b* while it is transferred toward the home position from the print area, the carriage 16 presses the slider 32 toward the home position, resisting against the urging force of the urging spring 33 so that the two guides pins 32*a* at each side of the slider 32 obliquely slide up while they are guided by the guide holes 31*a*. At this time, the height of the slider 32, i.e. the height of the cap 27 can be adjusted depending on the position of the carriage 16. With this embodiment, the carriage 16 is set so as to have a plurality of stop positions (3 positions in this example) so that the height of the cap 27 can be adjusted in a plural number of steps (three steps in this example) in a range from the recovery position (the lowermost position) of the cap 27 to the capping position (the uppermost position).

As shown in FIG. 2, in this embodiment, at the time of three-step adjustment of the cap 27, the guide pins 32*a* are placed at three positions A, B, and C of the inclined portion of the guide holes 31*a* shown by a dashed-two dotted line and a solid line. The position of the carriage 16 when each of the guide pins 32*a* is placed at the position A is called a first position 1, a position of the carriage 16 when each of the guide pins 32*a* is placed at the position B is called a second position 2, and a position of the carriage 16 when the each of the guide pins 32*a* is placed at the position C is called a third position 3. The height of the cap when the carriage 16 is placed at the first position 1 is a regular cap height at the time of nozzle inspection which will be described below. The second and third positions 2 and 3 are positions for adjusting the height of the cap so that the nozzle inspection can be correctly performed in the case in which the nozzle inspection cannot be performed properly at the regular cap height.

The locking lever 29 regulates the carriage 16, which is transferred to and stays at the home position, not to return to the print area when the carriage 16 returns by receiving the recovery force of the urging spring 33 via the engagement portion 32*b* while the locking lever 29 is in contact with the carriage 16. The locking lever 29 also positions the carriage 16 at a predetermined stop position.

Figure 3:
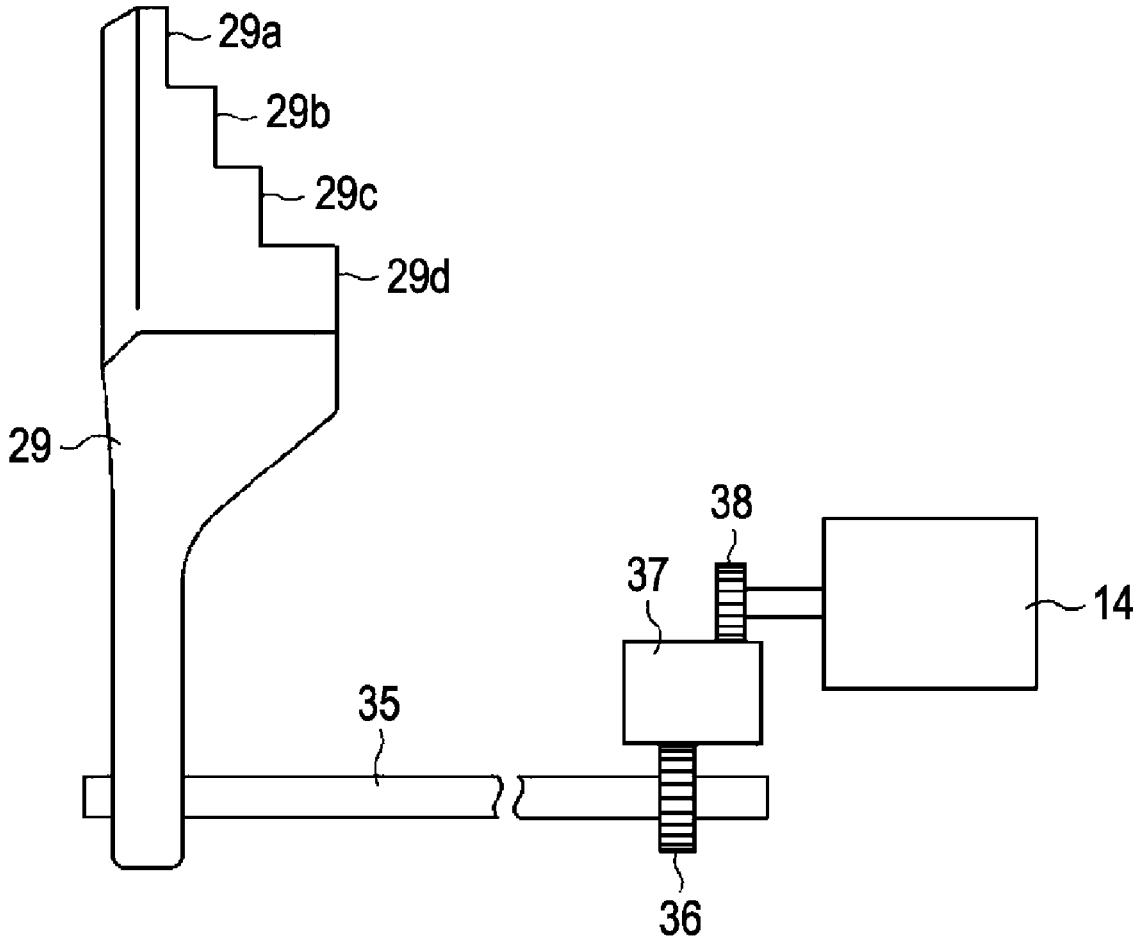
FIG. 3 is a schematic side view illustrating a locking lever drive mechanism.
Figure 4A:
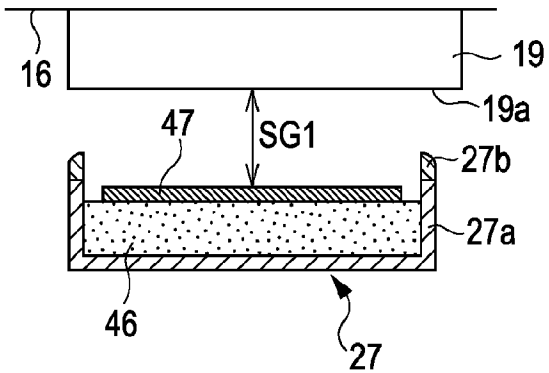
FIGS. 4A to 4C are schematic cross-sectional views for explaining the relationship between a position of a carriage and a gap.
Figure 4B:
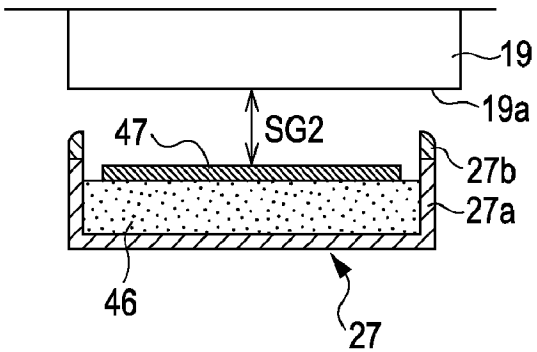
Figure 4C:
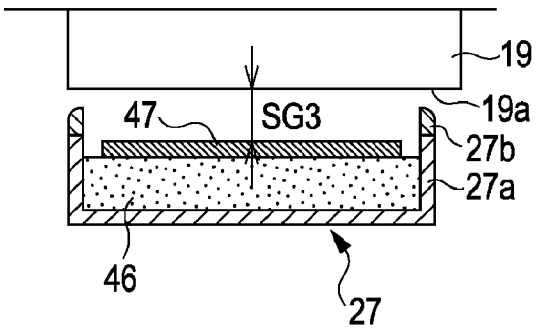

FIG. 3 is a schematic side view illustrating a locking lever drive mechanism. FIG. 3 shows a state in which the locking lever 29 is in a posture in which it slightly inclines toward the front side. As shown in FIG. 3, the locking lever 29 is pivotably disposed about a pivoting shaft 35 placed in parallel with a primary scan direction X. A gear 36 fixed to the pivoting shaft 35 engages with an output gear (not shown) of a drive power delivery mechanism 37 which delivers drive power of the PF motor 14, and a pinion 38 fitted to the output shaft of the PF motor 14 engages with an input gear (not shown) of the drive power delivery mechanism 37. When the PF motor 14 performs a backward drive in an opposite direction of a paper transporting direction, the locking lever 29 pivots by a pivot angle according to the rotation amount of the motor. When the PF motor 14 performs a forward drive in the paper transporting direction, the locking lever 29 is maintained at the recovery position at which the locking lever does not engage with the carriage 16.

As shown in FIG. 3, four regulating surfaces 29*a*, 29*b*, 29*c*, and 29*d* which can engage with the carriage 16 are formed stepwise at a lead end portion of the locking lever 29 in a manner such that positions of the surfaces are different in the primary scan direction X (left-and-right direction of FIG. 3). Here, when the locking lever 29 is pivoted by a pivot angle $\theta$ from the recovery position, the first regulating surface 29*a* is brought into contact with the carriage 16 and regulates the carriage 16 to be placed at the first position 1 when the pivot angle $\theta$ of the locking lever 29 is $\alpha$ (first posture angle). The second regulating surface 29*b* is brought into contact with the carriage 16 when the pivot angle $\theta$ of the locking lever 29 is $\beta$ (second posture angle, $\beta>\alpha$) and regulates the carriage 16 to be placed at the second position. The third regulating surface 29*c* is brought into contact with the carriage 16 when the pivot angle $\theta$ of the locking lever 29 is $\gamma$ (third posture angle, $\gamma>\beta$) and regulates the carriage 16 to be placed at the third position 3. The fourth regulating surface 29*d* is brought into contact with the carriage 16 when the pivot angle $\theta$ of the locking lever 29 is $\delta$ ($\delta>\gamma$) and regulates the carriage 16 at the capping position to be placed at which the cap 27 can contact the nozzle orifice surface 19*a*.

Next, the electrical configuration of the printer 11 will be described with reference to FIG. 5. The printer 11 includes a control device 41, motor drivers 42 and 43, a head driver 44, a PF motor 14, a CR motor 18, a recording head 19, a maintenance device 25, and a nozzle inspection device 45 which can detect a defective nozzle which cannot discharge the appropriate amount of ink.

The structure of the cap 27 will be described first. As shown in FIG. 5, the cap 27 includes a cap main body 27*a* which is open at an upper portion thereof and is in a quadrangle box form, and a cap sealing portion 27*b* which is made of an elastic material, such as synthetic rubber, and in a ring form fixed to the upper portion of the cap main body 27*a*. In the cap 27, an ink absorbing member 46 made of a porous material (for example, sponge) having water absorbability is provided so as to fill the entire inside space of the cap 27 without allowing gap around the inner circumferential surface of the cap main body 27*a*. In the cap 27, a detection electrode 47 is in a state in which the detection electrode 47 in a square net form which serves as an inspection electrode is in contact with the upper surface of the ink absorbing member 46 and weakly presses the ink absorbing member 46 from the upside and is maintained in the state in which the detection electrode 47 engages with the engagement portion (not shown) disposed in the cap 27. The detection electrode 47 is composed of, for example, an SUS plate having a plurality of holes and placed so as to cover almost the entire upper surface of the ink absorbing member 46 (while allowing a portion of the ink absorbing member 46 which is lower than the hole to be exposed to the air). Ink droplets discharged toward the inside of the cap 27 from the nozzle 22 of the recording head 19 will be placed on the detection electrode 47.

A tube portion 27*c* protruding from the bottom of the cap 27 is connected to an ink suction tube 48 extending from a suction pump 30. An ink discharge tube 49 extending from the suction pump 30 is connected to a waste fluid tank 39 (shown in FIG. 1). With this embodiment, the suction pump 30 is structured in a manner such that suction force (negative pressure) reaches the inside of the cap 27 when the suction pump 30 starts to pump as the PF motor 14 performs a backward drive in an opposite direction of the drive direction (forward drive direction) at the paper transporting time in the middle of printing.

The cap 27 caps the recording head 19 in order to prevent ink in the nozzles of the recording head 19 from thickening or drying in a non-printing stage. In addition to the use for the capping, the cap 27 is also used as an ink droplet disposal area when periodically performing flushing for idly discharging thickened ink in the nozzles at every predetermined time (for example, a predetermined value in the range from 5 to 20 seconds) in a printing state. In the flushing, the carriage 16 is transferred to the home position whenever a predetermined time passes in the middle of printing, and the ink droplets are idly discharged all together to the inside of the cap 27 from the entire nozzles of the recording head 19. Of the entire nozzles of the recording head 19, ink change is performed in the nozzles used for printing by the ink droplet discharge. However, the ink change is not performed in the nozzles which are not used for printing, so that the ink gradually becomes thicker. As a result, with the progress of the thickening, the nozzles become defective nozzles which cannot discharge the ink at last. To prevent the defective nozzles from occurring and maintain a good state of the entire nozzles which are not in a clogged state, the flushing is periodically performed by the control of the control device 41.

Further, a cleaning of the nozzles using the maintenance device 25 is periodically performed at every predetermined time or is performed after a predetermined time passes when at the time of power-on. The cleaning is processed for forcedly taking the ink off the nozzle orifice in a suction manner by starting the suction pump 30 in a capping state in which the cap 27 is in contact with the nozzle orifice surface 19*a* of the recording head 19. The ink remaining in the cap 27 after the flushing or cleaning is discharged into the waste fluid tank 39 (see FIG. 1) disposed under the platen 13 by the idle suction of the suction pump 30 in the state in which the cap 27 is open.

The nozzle inspection device 45 includes the detection electrode 47 and a nozzle inspection circuit 50. The nozzle inspection circuit 50 includes a voltage application circuit 51 which generates an electric field between the detection electrode 47 and the nozzle orifice surface 19*a* by applying a voltage (inspection voltage) between the detection electrode 47 and the nozzle orifice surface 19*a* of the recording head 19, an electrode potential detection circuit 54, an integration circuit 55 for detecting a change of the intensity of the electric field when inspection ink droplets are discharged, an inverting amplifier circuit 56, and an A/D converter circuit 57. In this example, a portion of the nozzle inspection circuit 50 is formed by, for example, an ASIC mounted on a subordinate substrate electrically connected to a main substrate on which the control device 41 is mounted.

The voltage application circuit 51 includes a DC/DC converter 52 and a switch circuit 53 for outputting an on/off signal for instructing the DC/DC converter 52 to output or not to output the inspection voltage (to be turned on or off). The DC/DC converter 52 is supplied with a predetermined direct current voltage (i.e. a voltage in the range from 20 to 60V) from the power supply circuit 58 during the printer 11 is turned on and outputs a predetermined direct current voltage (inspection voltage Vo) by raising the predetermined direct current voltage which is input. An output terminal of the DC/DC converter 52 is grounded (earthed) via a first resistor R1, a second resistor R2, and a third resistor R3 which are connected in series to one another, and a voltage divided by the first resistor R1, the second resistor R2, and the third resistor R3 is applied to the detection electrode 47.

On the other hand, a nozzle plate made of a metal (for example, the nozzle plate made of SUS) which is attached to the bottom of the recording head 19 so as to form the nozzle orifice surface 19*a* is grounded (earthed) to the main body frame 12 made of a metal via an earth wiring. The power supply circuit 58 changes and AC/DC-converts an alternate voltage (for example 100V) input through a power supply plug inserted into an outlet of a commercial alternating current power source 59 to a predetermined direct current voltage in a built-in AC/DC converter (not shown), and then outputs the predetermined direct current voltage to the DC/DC converter 52.

The electrode potential detection circuit 54 detects a potential (hereinafter, referred to as "an electrode potential") of the detection electrode 47 in a non-discharge time when the inspection ink droplets are not discharged. With this embodiment, the detection of the electrode potential by the electrode potential detection circuit 54 is performed before nozzle inspection (i.e. before beginning of discharge of inspection ink droplets). The electrode potential detection circuit 54 includes the second resistor R2, the third resistor R3, and an A/D converter circuit 60. The electrode potential detection circuit 54 outputs a detection signal having the electrode potential Vout obtained through processing in which a potential Vout of the detection electrode 47 is divided by the second and third resistors R2 and R3, and the divided voltage is A/D-converted by the A/D converter circuit 60, as a detection value.

The nozzle inspection circuit 50 is applied with a potential between the first resistor R1 and the second resistor R2 (i.e. a potential of the detection electrode 47) via a condenser C. Owing to the condenser C, a detection wave composed of a frequency component in a predetermined frequency range when the potential of the detection electrode 47 changes according to the change of the electric field intensity between the nozzle orifice surface 19*a* and the detection electrode 47, which is attributable to the discharge of ink droplets, is input to the nozzle inspection circuit 50. The nozzle inspection circuit 50 includes an integration circuit for integrating the detection wave and output the integration result, an inverting amplifier circuit 56 for inverting and amplifying the signal output from the integration circuit 55, and an A/D converter circuit 57 for outputting the detection value to the control device 41 by A/D-converting the signal output from the inverting amplifier circuit 56.

The principle of the nozzle inspection of the nozzle inspection device 45 will be described with reference to FIG. 6. As one ink droplet is discharged onto the detection electrode 47 in the cap 27 from one nozzle 22, the nozzle inspection is performed. As shown in FIG. 6A in the inspection on state, the detection voltage from the DC/DC converter 52 is applied, the nozzle orifice surface 19*a* is negatively charged, and the detection electrode 47 is positively charged. As shown in FIG. 6B, in this inspection on state, if an ink droplet is discharged from an inspection subject nozzle 22, the ink droplet discharged from the nozzle 22 is negatively charged. As the negatively charged ink droplet approaches the detection electrode 47, the amount of positive charges gradually increases on the detection electrode 47 due to electrostatic induction. As a result, a potential difference (i.e. also electric field) between the detection electrode 47 and the nozzle orifice surface 19*a* becomes relatively large in comparison with the case in which the ink droplet is not discharged from the nozzle 22 due to the induction voltage attributable to the electrostatic induction.

Figures 6A, 6B, 6C:
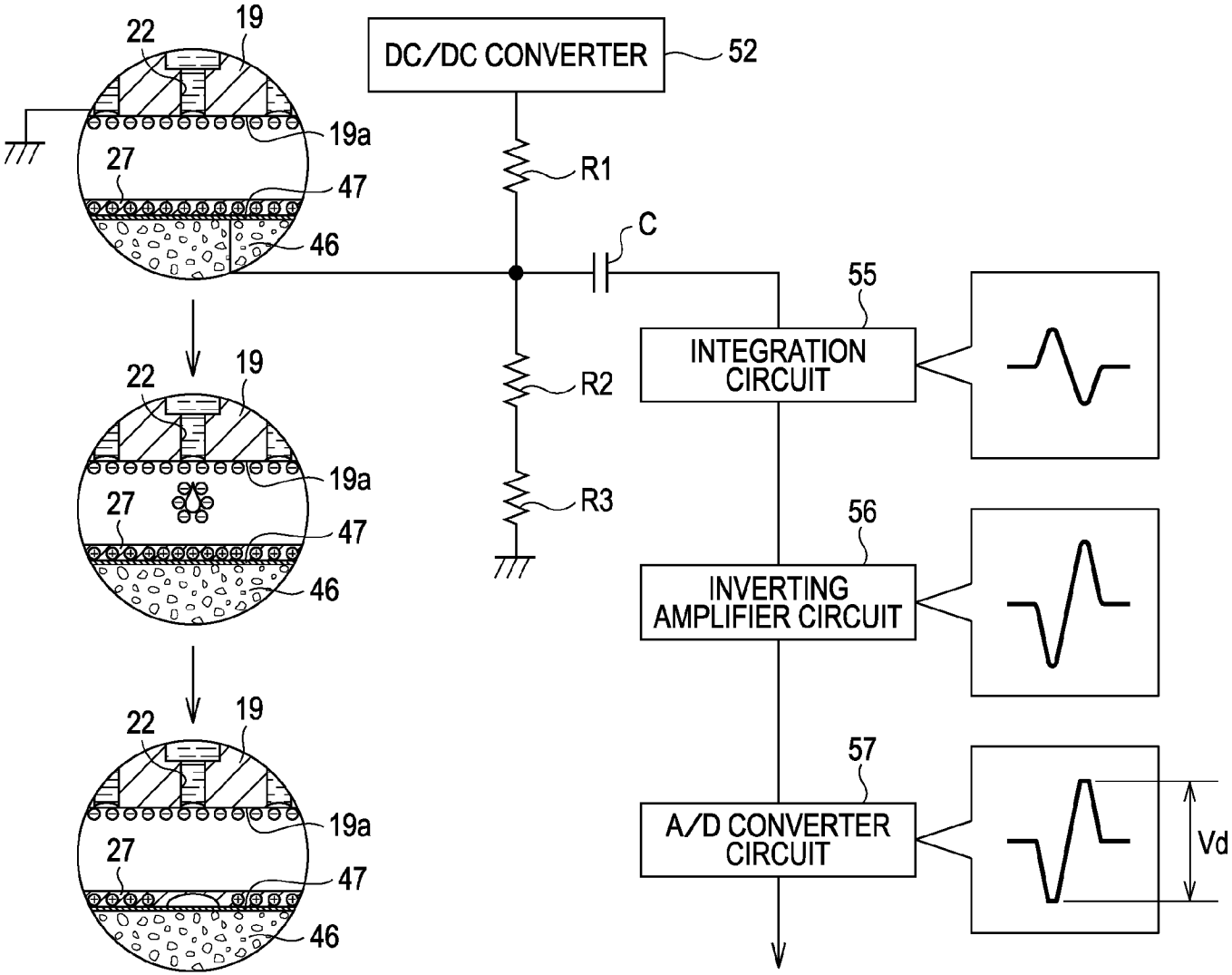
FIGS. 6A to 6C are schematic views for explaining a nozzle inspection principle.

When the ink droplet discharged from the nozzle 22 is placed on the detection electrode 47, as shown in FIG. 6C, some portion of the positive charges on the detection electrode 47 is neutralized by the negative charges on the ink droplet. As a result, the potential difference (voltage) between the detection electrode 47 and the nozzle orifice surface 19*a* of the recording head 19 becomes relatively small in comparison with the case in which the ink droplet is not discharged from the nozzle 22. After that, the potential difference between the detection electrode 47 and the nozzle orifice surface 19*a* of the recording head 19 is recovered to the original value.

The detection wave input via the condenser C is integrated by the integration circuit 55, inverted and amplified by the inverting amplifier circuit 56, A/D-converted by the A/D converter circuit 57, and output to the control device 41 as the detection value. When the appropriate amount of ink droplet is discharged from the nozzle, the amplitude of the detection wave Vd (the amplitude of the detection voltage) (see FIG. 6C) comes to exceed a predetermined threshold value. Accordingly, in the case in which the amplitude of the detection wave Vd does not exceed the predetermined threshold value, it is determined such that the inspection subject nozzle is a defective nozzle which cannot discharge the appropriate amount of the ink droplet.

Therefore, the ink is discharged into the cap 27 in which the detection electrode 47 is placed when performing the flushing or the cleaning. The ink accumulated in the cap 27 is discharged when an idle suction is performed. However, since the ink on the detection electrode 47 is not completely removed even by the idle suction, ink or dry matter of ink is deposited on the detection electrode 47 and forms an ink layer. The presence of the ink layer influences a dielectric constant between the recording head 19 and the detection electrode 47, and therefore the potential of the detection electrode 47 is lowered. The lowering of the electrode potential results in the lowering of the amplitude of the detection wave Vd, which causes deterioration of the nozzle inspection precision. Accordingly, if the ink or the dry matter of the ink is deposited on the detection electrode 47, the amplitude of the detection wave Vd is decreased to the predetermined threshold value or less so that there can be the possibility that it is determined such that the inspection subject nozzle is the defective nozzle although the appropriate amount of ink droplet is discharged. Besides the ink, paper powder attached to the upper surface of the detection electrode 47 also can lower the electrode potential.

The control device 41 performs a nozzle inspection control in addition to the print control and the maintenance control. The control device 41 controls the nozzle inspection circuit 50 and performs nozzle inspection processing on the basis of various detection signals input from the nozzle inspection circuit 50 when performing the nozzle inspection control. In the nozzle inspection processing, processing of preventing the nozzle inspection precision from being lowered due to the lowering of the electrode potential which is attributable to the deposition of the ink layer on the detection electrode 47 is performed.

The control device 41 includes an operation portion 61, a comparison processing portion 62, a defective nozzle determination portion 63, a memory 64, and a main control portion 65 for the nozzle inspection processing. The operation portion 61 and the comparison processing portion 62 is a member for determining whether the required nozzle inspection precision can be obtained on the basis of the detection value (electrode potential Vout) output from electrode potential detection circuit 54. As a result of the determination, in the case in which the required nozzle inspection precision can not be obtained, the main control portion 65 adjusts the gap SG to a width which is appropriate to obtain the required nozzle inspection precision by changing the inspection position of the carriage 16. The defective nozzle determination portion 63 is a member for determining presence of the defective nozzle on the basis of the detection value which is obtained by detecting the change of the intensity of the electric field and is input from the nozzle inspection circuit 50 when discharging the ink droplet. The memory 64 stores various kinds of data such as the threshold value used by the comparison processing portion 62 when performing the comparative determination and the threshold value used by the defective nozzle determination portion 63 when performing the comparative determination. The detailed contents of processing performed by the operation portion 61, the comparison processing portion 62, and the defective nozzle determination portion 63 will be described below.

The control device 41 includes a CR control portion 66, a PF control portion 67, and a head control portion 68 for controlling the drive of the CR motor 18, the PF motor 14, and the recording head 19, respectively on the basis of the instructions from the main control portion 65. The CR control portion 66 controls the drive of the CR motor 18 by means of a motor driver 42. The PF control portion 67 controls the drive of the PF motor 14 by means of a motor driver 43. The head control portion 68 controls the drive of the recording head 19 by means of a head driver 44. Here, the main control portion 65 includes a print control portion 71 and a maintenance control portion 72. The print control portion 71 performs print processing by instructing the control portions 66 to 68 to drive the motors 14 and 18 and the recording head 19, respectively. The control device 41 is provided with a timer 69. The timer 69 counts a predetermined time period for performing the cleaning and a predetermined time period for performing the flushing. The maintenance control portion 72 instructs the respective control portions 66 and 67 to drive the motors 14 and 18 when the maintenance control portion 72 receives a notification to the effect that the cleaning time arrives in execution from the timer 69, so that the maintenance device 25 performs nozzle cleaning with respect to the recording head 19. The maintenance control portion 72 instructs the respective control portions 66 and 68 to drive the motor 18 and the recording head 19 when the maintenance control portion 72 receives a notification to the effect that the flushing time arrives in execution from the timer 69, so that the flushing is performed with respect to the recording head 19. The main control portion 65 sends a nozzle inspection start signal to the nozzle inspection circuit 50 when the main control portion 65 receives a notification to the effect that it is time to perform the nozzle inspection from the timer 69 or receives a nozzle inspection execution demand on the basis of manipulation of an input manipulation portion (not shown). The nozzle inspection circuit 50 is structured in a manner such that when the nozzle inspection circuit 50 receives the nozzle inspection start signal, the switch circuit 53 drives the DC/DC converter 52 by outputting an on signal to the DC/DC converter 52, and therefore the inspection voltage of the nozzle inspection device 45 falls to an on state.

Next, nozzle inspection processing performed in the control device 41 will be described in detail.

The operation portion 61 operates an electrode potential relative value VPout on the basis of the electrode potential Vout input from the electrode potential detection circuit 54. The electrode potential relative value VPout is a ratio of the electrode potential Vout with respect to an initial electrode potential Voutini which is a potential of the detection electrode 47 at the time of shipment which is measured under a condition in which the inspection voltage is applied from the DC/DC converter 52, and is expressed in "%". That is, it is expressed by an equation of VPout=Vout/Voutini (%).

The comparison processing portion 62 performs comparison processing of determining whether the electrode potential relative value VPout exceeds the threshold value. In this example, for example, three threshold values VP1, VP2, and VP3 (100>VP1>VP2>VP3>0) (%) are stored in the memory 64, and it is determined to which range out of three ranges the electrode potential relative value VPout belongs using the threshold value read out from the memory 64. That is, when VPout≧VP1, VP1>VPout≧VP2, and VP2>VPout≧VP3, it is determined such that the electrode potential is in a normal range, a first abnormal range, and a second abnormal range, respectively. On the other hand, when VPout<VP3, it is determined such that the electrode potential is an error. In this example, the ranges of the electrode potential is divided into four steps including an error, but it can be determined that it was appropriate if there were two or more steps. If the electrode potential relative value VPout determined by the comparison processing portion 62 is in the first abnormal range or the second abnormal range, the main control portion 65 performs a control to drive the CR motor 18 for transferring the carriage 16 to the inspection position corresponding to the range. In greater detail, in the case in which the electrode potential relative value VPout is in the normal range, the first position 1 of the carriage 16 becomes the inspection position. In the case in which the electrode potential relative value VPout is in the first abnormal range, the second position 2 of the carriage 16 becomes the inspection position. In the case in which the electrode potential relative value VPout is in the second abnormal range, the third position 3 of the carriage 16 becomes the inspection position.

FIG. 4 is a schematic side view illustrating the relationship between the stop position of the carriage 16 and the gap SG. When the carriage 16 is placed at the first position 1, the first gap SG1 is securely ensured between the nozzle orifice surface 19*a* and the inspection electrode 47. When the carriage 16 is placed at the second position 2, the gap SG2 (<SG1) smaller than the first gap SG1 is securely ensured between the nozzle orifice surface 19*a* and the detection electrode 47. When the carriage 16 is placed at the third position 3, the third gap SG3 (<SG2) smaller than the second gap SG2 is securely ensured between the nozzle orifice surface 19*a* and the detection electrode 47. This embodiment provides a structure in which the gap SG is adjusted by adjusting the height of the gap 27 in three steps, but the structure can be altered to a structure in which the height can be adjusted in multiple steps, such as four or more steps so that the gap at the time of nozzle inspection can be adjusted in a range of four or more steps.

When the adjustment of the gap SG is finished at the time of nozzle inspection, the main control portion 65 instructs the head control portion 68 to discharge ink droplets for inspection. The head control portion 68 comes to discharge in order a single ink droplet or a plural number of ink droplets from each of the nozzles 22 of the recording head 19 on the basis of the inspection discharge data read out from the memory 64. At this time, negatively charged ink droplets are discharged from the nozzles 22 of the recording head 19, and the discharged ink droplets are placed on the positively charged detection electrode 47. The change of the intensity of the electric field attributable to the discharge of the ink droplets is input to the integration circuit 55 via the condenser C as the detection wave. The detection wave input to the integration circuit 55 is output to the defective nozzle determination portion 63 of the control device 41 as the detection value which is approximately proportional to the amplitude Vd of the detection wave via the integration circuit 55, the inverting amplifier circuit 56, and the A/D converter circuit 57.

The defective nozzle determination portion 63 determines whether the detection value indicating the amplitude of the change of the intensity of the electric field, which is input, is equal to or above a preset threshold value K. The threshold value K is a threshold value for determining whether the appropriate amount of ink droplet is discharged from the nozzle 22 and is obtained beforehand by an experiment or a simulation. In the case in which the detection value exceeds the threshold value K, it is determined such that the inspection subject nozzle is not a defective nozzle. Conversely, in the case in which the detection value does not exceed the threshold value K, the inspection subject nozzle is the defective nozzle.

The defective nozzle determination portion 63 notifies the main control portion 65 the purport that the inspection subject nozzle is a defective nozzle whenever it is determined such that the inspection subject nozzle is defective. The main control portion 65 determines whether the cleaning execution condition is satisfied whenever it receives the notification of the purport of the defective nozzle from the defective nozzle determination portion 63. The cleaning execution condition means, for example, the case in which the number of the defective nozzle is a predetermined numeral (for example, one) or more, or the case in which a plural number of defective nozzles forms a group (for example, the defective nozzles are adjacent to one another). In the case in which the cleaning execution condition is satisfied, the main control portion 65 interrupts the nozzle inspection at that time or completes the course of the nozzle inspection, and then drives the maintenance device 25 by the maintenance control portion 72 so that the nozzles of the recording head 19 is cleaned. In this embodiment, the nozzle inspection device 45 includes the detection electrode 47, the nozzle inspection circuit 50, a member of the control device 41 which performs nozzle inspection-related processing (for example, gap adjustment processing, inspection ink droplet discharge processing, defective nozzle detection processing, et al.), the CR motor 18, and the elevating and lowering mechanism 26.

Figure 7:
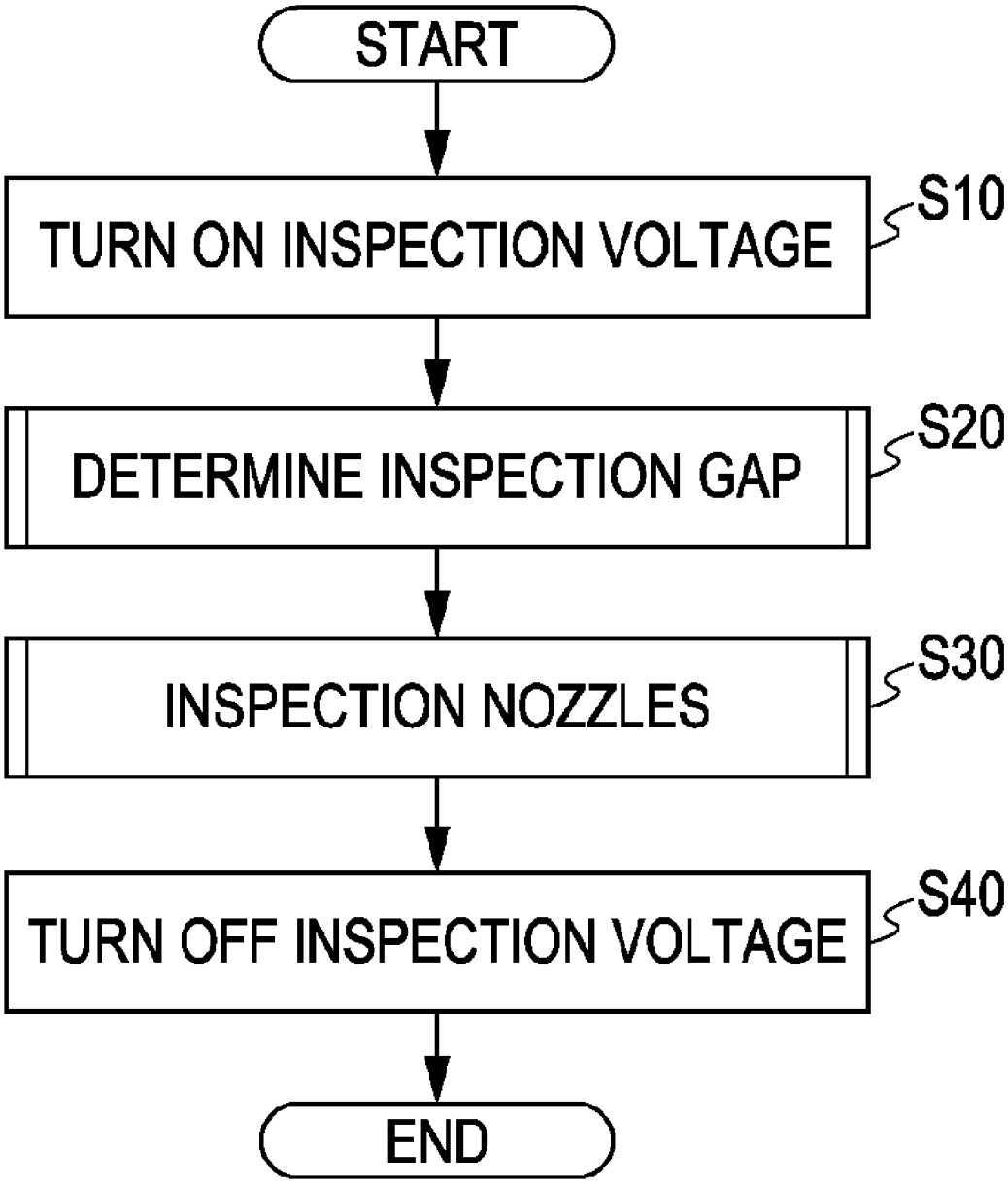
FIG. 7 is a flowchart illustrating nozzle inspection processing.
Figure 8:
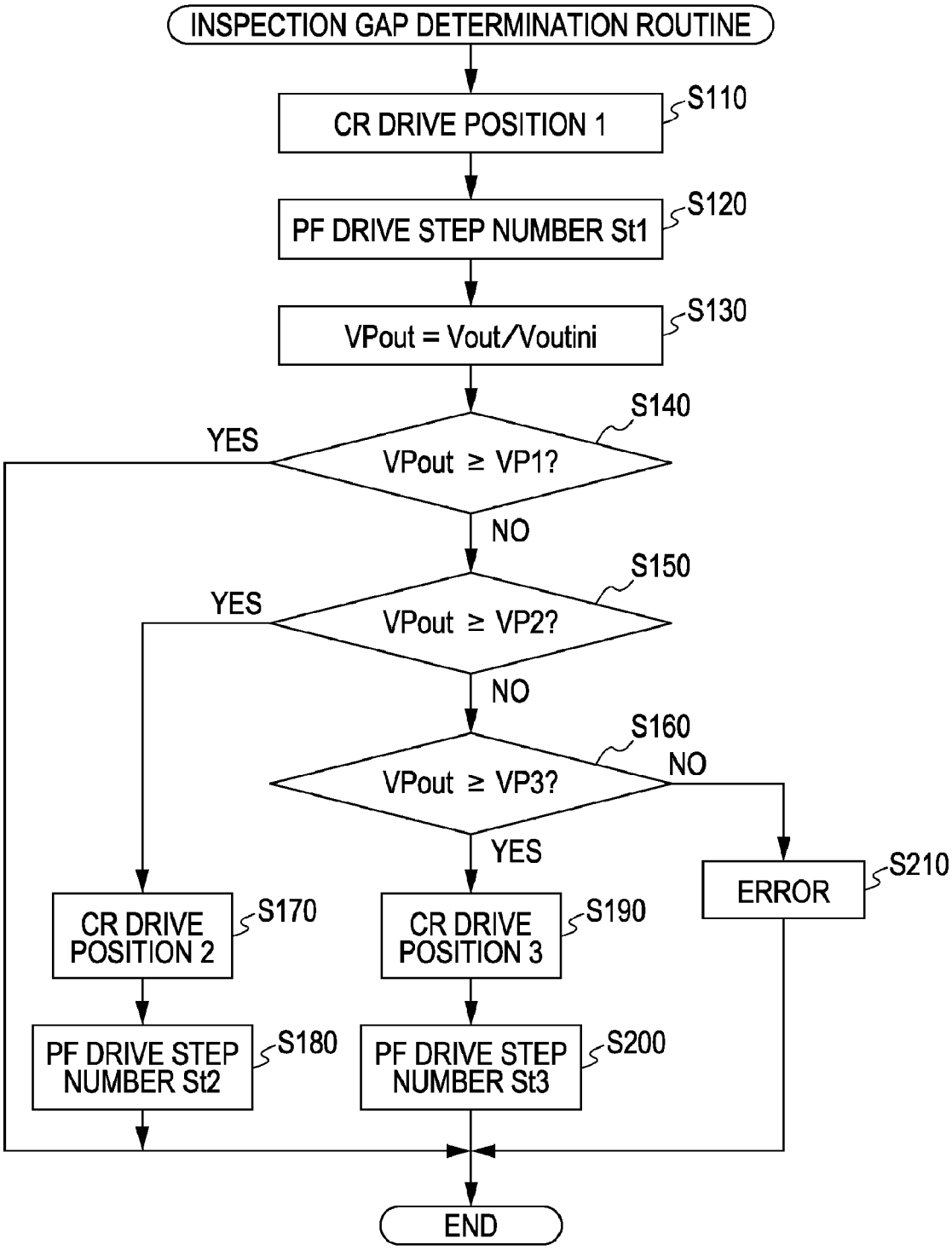
FIG. 8 is a flowchart illustrating an inspection gap determination routine.

Next, an operation of the nozzle inspection device will be described with reference to the flowcharts of FIG. 7 and FIG. 8. The control device 41 executes the nozzle inspection processing routine (nozzle inspection sequence) shown in the flowcharts of FIGS. 7 and 8 when the timer 69 counts a predetermined time and thus it becomes the timing of nozzle inspection.

In Step S10, the inspection voltage is turned on. If the nozzle inspection start signal is output to the nozzle inspection circuit 50, the switch circuit 53 of the nozzle inspection circuit 50 output an on signal to the DC/DC converter 52 so that the main control portion 65 turns on the detection voltage of the nozzle inspection device 45. In the case of the this embodiment, if the inspection voltage output from the DC/DC converter 52 is set to a predetermined value (for example, a predetermined value in a range from 200 to 400V), and the inspection voltage is turned on, the inspection voltage is applied between the nozzle orifice surface 19*a* of the recording head 19 and the detection electrode 47. As a result, the electric field having a predetermined intensity determined by the application voltage between the nozzle orifice surface 19*a* and the detection electrode 47 and the gap SG is generated. The potential of the detection electrode 47 depends on the deposition state of the ink layer.

In Step S20, determination of the inspection gap is performed. That is, the gap is adjusted to the initial gap SG1, and the potential of the detection electrode 47 is detected under the condition of the gap SG1. So the gap SG appropriate for the inspection is determined on the basis of the detection value. As the result of the determination, in the case in which the gap SG appropriate for the inspection is different from the initial gap SG1, the current gap SG1 is changed to the gap SG appropriate for the inspection.

In Step S30, the nozzle inspection is performed. That is, ink droplets are discharged from nozzle by nozzle in order from the recording head 19 to the inside of the cap 27, and it is inspected whether the inspection subject nozzles are defective or not. In more detail, when the print control portion 71 is instructed to perform a detection discharge operation on the basis of the inspection discharge data, the print control portion 71 drives the recording head 19 by using the head driver 44 on the basis of the inspection discharge data (inspection print data) and the recording head 19 discharges a single ink droplet or a plurality of ink droplets (for example, three droplets) from nozzle by nozzle in order. Therefore, it is determined whether the inspection subject nozzle is defective, nozzle by nozzle, on the basis of the detection value obtained by detecting the change of the intensity of the electric field which is attributable to the discharge of ink droplets.

In Step S40, the inspection voltage is turned off. That is, the control device 41 instructs the nozzle inspection circuit 50 to turn off the inspection voltage, the switch circuit 53 outputs an off signal to the DC/DC converter 52 and outputting of the inspection voltage is interrupted.

Next, inspection gap determination processing will be described in more detail.

First, in step S110, the CR motor 18 is driven until the carriage 16 reaches the first position 1 (see FIG. 4A) (CR drive). Subsequently, in Step S120, the PF motor 14 is driven by a rotation amount specified in the number of steps St1 (PF drive). As a result, the carriage 16 is placed at the first position 1, the locking lever 29 is placed at a first posture angle, and the carriage 16 is regulated to be positioned at the first position while it is in contact with the first regulating surface 29*a* of the locking lever 29. As a result, the cap 27 is placed at the height at which the gap between the nozzle orifice surface 19*a* and the detection electrode 47 becomes the gap SG1. In the state in which the gap is adjusted to the gap SG1, the electrode potential Vout is input to the control device 41 from the electrode potential detection circuit 54 of the nozzle inspection circuit 50. The electrode potential Vout is a voltage formed before the ink droplets are discharged under the condition of the gap SG1.

In Step S130, the electrode potential relative value VPout (=Vout/Voutini) is calculated.

In the processing of subsequent Steps S140 to S200, the gap SG is adjusted to the width depending on the electrode potential relative value VPout. In greater detail, whether the potential of the detection electrode 47 is in a range in which the required inspection precision can be ensured is determined by comparing the electrode potential relative value VPout with the threshold value. In this example, three threshold voltages VP1, VP2, and VP3 are prepared for the comparison processing.

First, in Step S140, whether VPout≧VP1 is determined. When VPout≧VP1 is established, since the gap is adjusted to the gap SG1 beforehand, the routine ends. On the other hand, when VPout≧VP1 is not established (NO in Step S140), Step S150 is performed.

In Step S150, whether VPout≧VP2 is determined. When VPout≧VP2 is established, Step S170 is performed and therefore the CR motor 18 is driven until the carriage 16 reaches the second position 2 (see FIG. 4B) (CR drive). In the subsequent step, S180, the PF motor 14 is driven by the rotation amount specified in the number of steps St2 (PF drive). As a result, the carriage 16 is placed at the second position 2 and the locking lever 29 is placed at a second posture angle. Therefore the carriage 16 is in contact with the second regulating surface 29*b* of the locking lever 29 and the position thereof is regulated to be disposed at the second position 2. With this operation, the cap 27 is placed at the height at which the gap between the nozzle orifice surface 19*a* and the detection electrode 47 becomes the gap SG2.

When VPout≧VP2 is not established (NO in Step S150), Step S160 is performed. In Step S160, whether VPout≧VP3 is determined. When VPout≧VP3 is established, Step S190 is performed. That is, the CR motor 18 is driven until the carriage 16 reaches the third position 3 (see FIG. 4C) (CR drive). Subsequently, in Step S200, the PF motor 14 is driven by the rotation amount specified in the number of steps St3 (PF drive). As a result, the carriage 16 is placed at the third position 3 and the locking lever 29 is placed at the third posture angle. As a result, the carriage 16 is in contact with the third regulating surface 29*c* of the locking lever 29 and the position thereof is regulated to be disposed at the third position 3. Accordingly, the cap 27 is placed at the height at which the gap between the nozzle orifice surface 19*a* and the detection electrode 47 becomes the gap SG3.

When VPout≧VP3 is not established (NO in Step S160), the processing progresses to Step S210, error determination. That is, when VPout<VP3, since it cannot deal with the case by adjustment of the gap SG, the processing ends in error.

As described above, since the electrode potential relative value VPout, which is an relative value of the electrode potential Vout with respect to the initial electrode potential Voutini which is a potential at the time of shipment, is obtained when the inspection voltage is turned on, if it is determined such that the required nozzle inspection precision cannot be obtained as VPout≧VP1 is not established, the gap SG is adjusted to the gap SG according to the electrode potential relative value VPout, and therefore the required nozzle inspection precision can be ensured. Accordingly, even if the ink layer is deposited on the detection electrode 47, since the amplitude Vd of the detection wave becomes a required value, it becomes possible to surely detect the ink droplets normally discharged from the nozzles 22. For example, it is possible to eliminate the trouble such that the inspection subject nozzle is determined as the defective nozzle as the detection value according to the amplitude Vd of the detection wave does not exceed the threshold value K, although the ink droplets are normally discharged from the nozzles 22, owing to the deposition of the ink on the detection electrode 47.

According to this above-mentioned embodiment, the following advantages can be obtained.

(1) In the case in which the initial electrode potential is detected and the detection value is below the threshold value, the amplitude of the detection wave which is needed to perform the normal nozzle inspection is obtained by increasing the initial electrode potential by decreasing the gap between the recording head 19 and the detection electrode 47. Accordingly, regardless of the deposition state of the ink or dry matter of ink on the detection electrode 47, it is possible to ensure the required nozzle inspection precision. As a result, it is possible to avoid unnecessary ink consumption and unnecessary standby time due to performing unnecessary cleaning which is attributable to the defective nozzle and erroneous detection even when the ink droplets are normally discharged from the nozzles.

(2) Since the locking lever 29 is structured so as to be able to position the carriage 16 in a plural number of steps, it is possible to maintain a desired width of the gap SG which depends on the detection value of the initial electrode potential. Accordingly, it is possible to obtain the stable inspection result and to improve the reliability of the nozzle inspection.

(3) As a method of increasing the amplitude of the detection wave to a level at which the nozzle inspection can be normally performed, there is a method of raising the application voltage. However, this embodiment adopts a method in which the application voltage does not change and the gap SG is decreased so that the amplitude of the detection wave is increased to a level at which the nozzle inspection can be normally performed. Accordingly, it is possible to avoid the increase of the voltage consumption in the middle of nozzle inspection. There is a need to use the power application device having a rated voltage to raise the application voltage. However, according to the structure of this embodiment, since the rated voltage is constant, it is possible to avoid the increase of the power and size of the voltage application device.

(4) As a method of increasing the amplitude of the detection wave to a level at which the nozzle inspection can be normally performed, there is a method of increasing the number of ink discharge time of a single nozzle. However, this embodiment adopts a method in which the number of ink discharge time does not change but the gap SG is decreased so that the amplitude of the detection wave is increased to a level at which the nozzle inspection can be normally performed. Accordingly, it is possible to avoid the increase of ink expenditure in the nozzle inspection.

(5) It is possible to detect that the detection electrode 47 is contaminated due to the deposition of the ink or the dry matter of ink as severe as the normal nozzle inspection becomes impossible from the detection result of the electrode potential. Accordingly, it is possible to simply detect ink contamination of the detection electrode 47, and furthermore the detection precision becomes relatively higher since the electrode potential and the amplitude of the detection wave is in the approximately proportional relationship.

Embodiments of the invention are limited to the above, but may be altered to the following modifications.

Figure 9B:
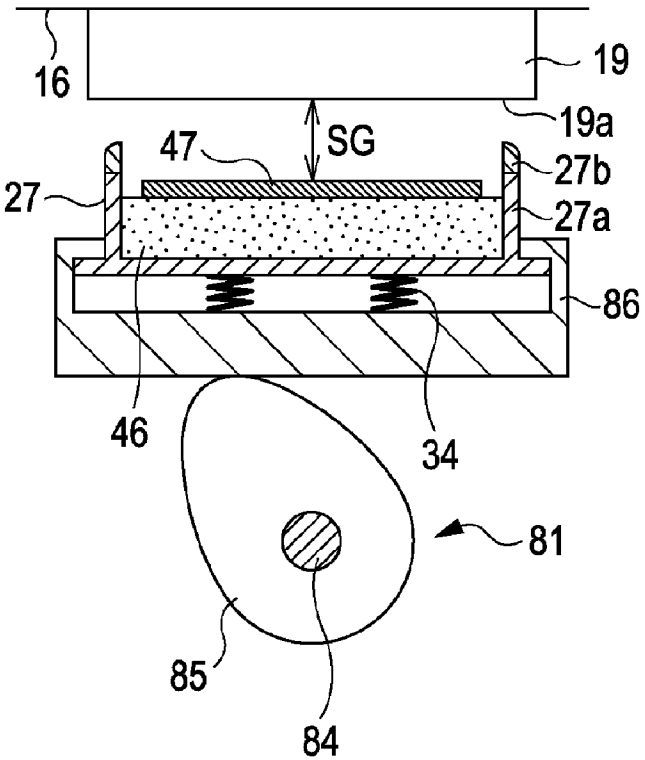
FIGS. 9A and 9B are schematic cross-sectional views illustrating a cap elevating and lowering mechanism according to a modification.
Figure 9A:
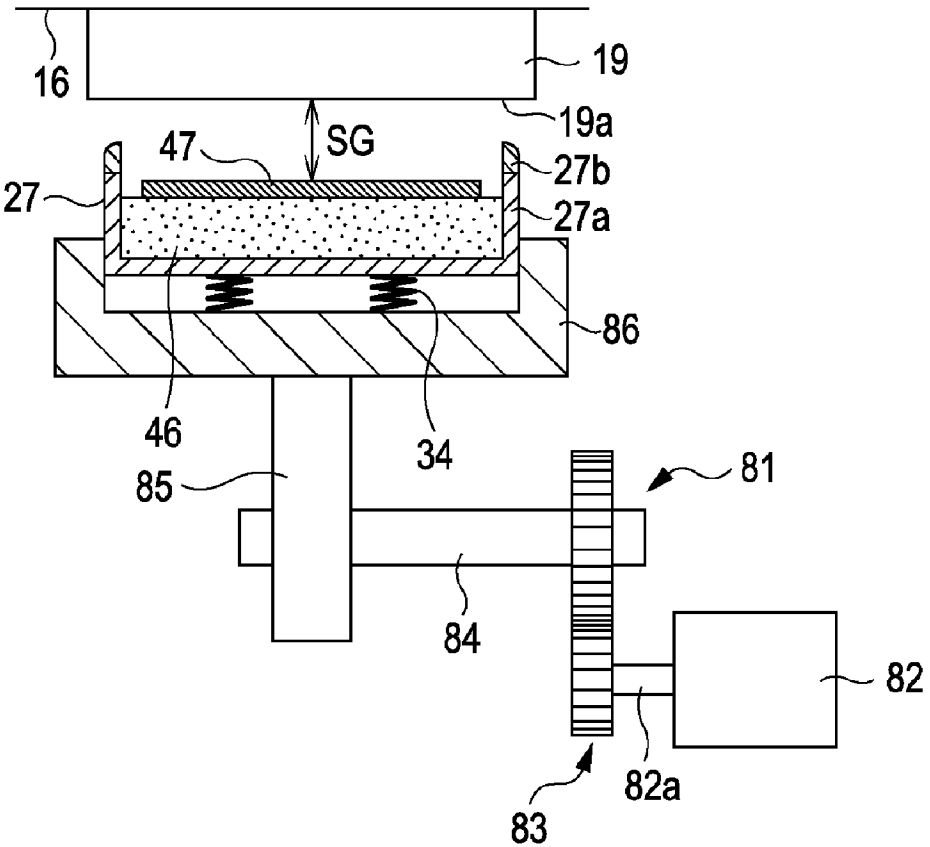

(Modification 1) The transfer mechanism (elevating and lowering mechanism) of the cap is not limited to a slider type in which the cap is reciprocated by moving the slider by the use of the pressing force at the time of transfer of the carriage 16. For example, an electric motor-driven type elevating and lowering device shown in FIGS. 9A and 9B can be adopted. That is, as shown in FIGS. 9A and 9B, the elevating and lowering device 81 includes an electric motor 82, a gear column 83 connected to an output shaft 82*a* of the electric motor 82, a rotating cam 85 integrally coupled to the output shaft 84 of the gear column 83 in a rotatable manner, and a base member 86 which is lifted and lowered by rotation of the rotating cam 85. As shown in FIG. 9B, the rotating cam 85 is eccentrically placed with respect to the output shaft 84 and its outer circumferential surface (cam surface) is in close contact with the bottom surface of the base member 86. If the electric motor 82 is driven forward and the rotating cam 85 rotates in a clockwise direction (rotates forward) in FIG. 9, the cap 27 is elevated by pushing up the base member 86. On the other hand, if the electric motor 82 is driven backward and the rotating cam 85 rotates in a counter clockwise (rotates backward) in FIG. 9, the cap 27 is lowered by lowering the base member 86. If such an electric motor-driven elevating and lowering device 81 is used, adjustment of the height of the cap 27, i.e. adjustment of the gap SG can be continuously performed.

Figure 10:
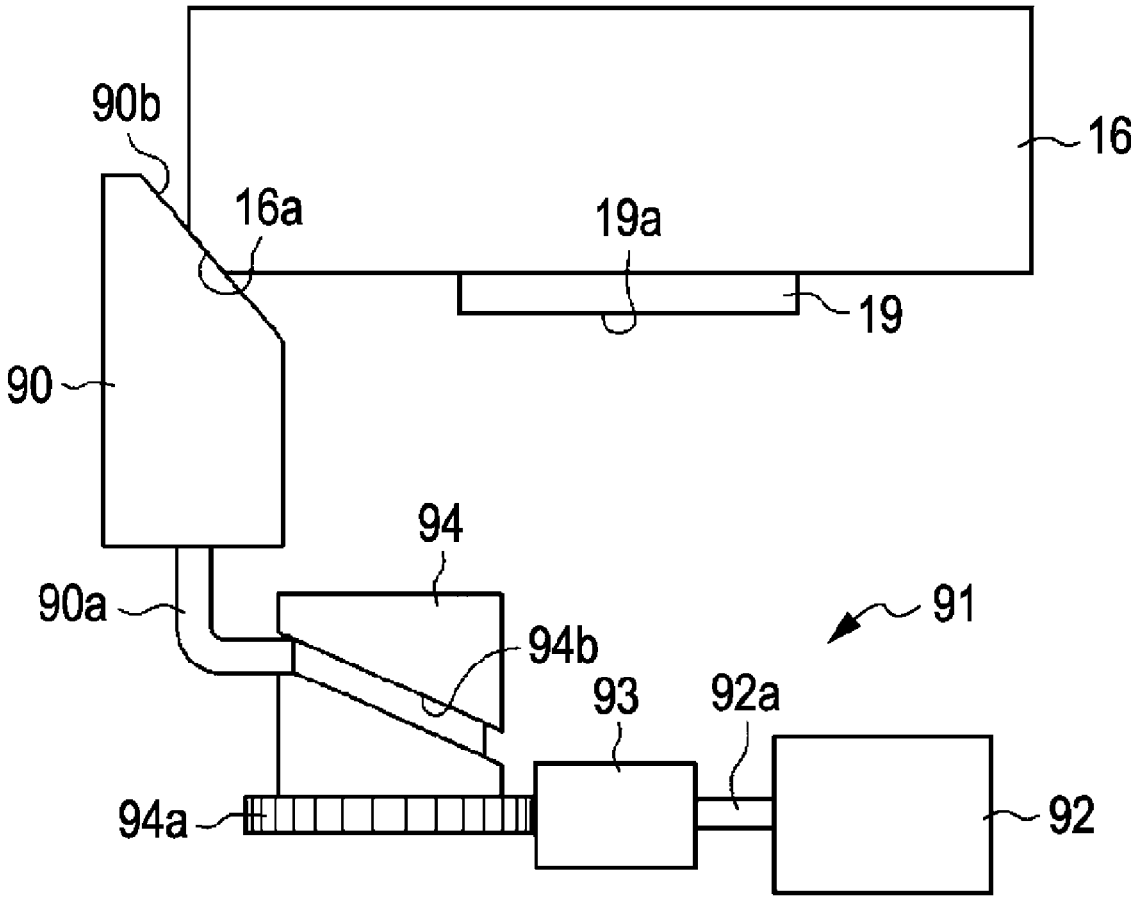
FIG. 10 is a schematic side view illustrating a locking lever elevating and lowering mechanism according to the modification.

(Modification 2) A structure in which the height of the cap in the slider type can be continuously changed. In this case, as shown in FIG. 10, the locking lever may adopt an electric motor-driven type. As shown in FIG. 10, the electric motor-driven type elevating and lowering device 91 which elevates and lowers the locking lever 90 includes an electric motor 92, a differential mechanism 93 connected to an output shaft 92*a* of the motor 92, and a cylinder cam 94 having a gear portion 94*a* engaging an output gear (not shown) of the differential mechanism 93. A cam trench 94*b* is formed in a form of a spiral path on the circumferential surface of the cylinder cam 94, and a base end portion of a cam follower shaft 90*a* which supports the locking lever 90 is engage with the cam trench 94*b*. The locking lever 90 has an engaging surface 90*b* having an inclined shape at an upper portion thereof. The position of the carriage 16 is determined at a predetermined locking position (inspection position) because the engaging surface 90*b* is in contact with the engaging surface 16*a* of the carriage 16. At this time, the locking position of the carriage 16 is adjusted by adjusting the height of the locking lever 90 by driving the electric motor 92 by the rotation amount according to the gap SG determined at that time. In this manner, since the locking position of the carriage 16 can be continuously adjusted, it is possible to continuously adjust the height of the cap 27, i.e. the gap SG.

Figure 11:
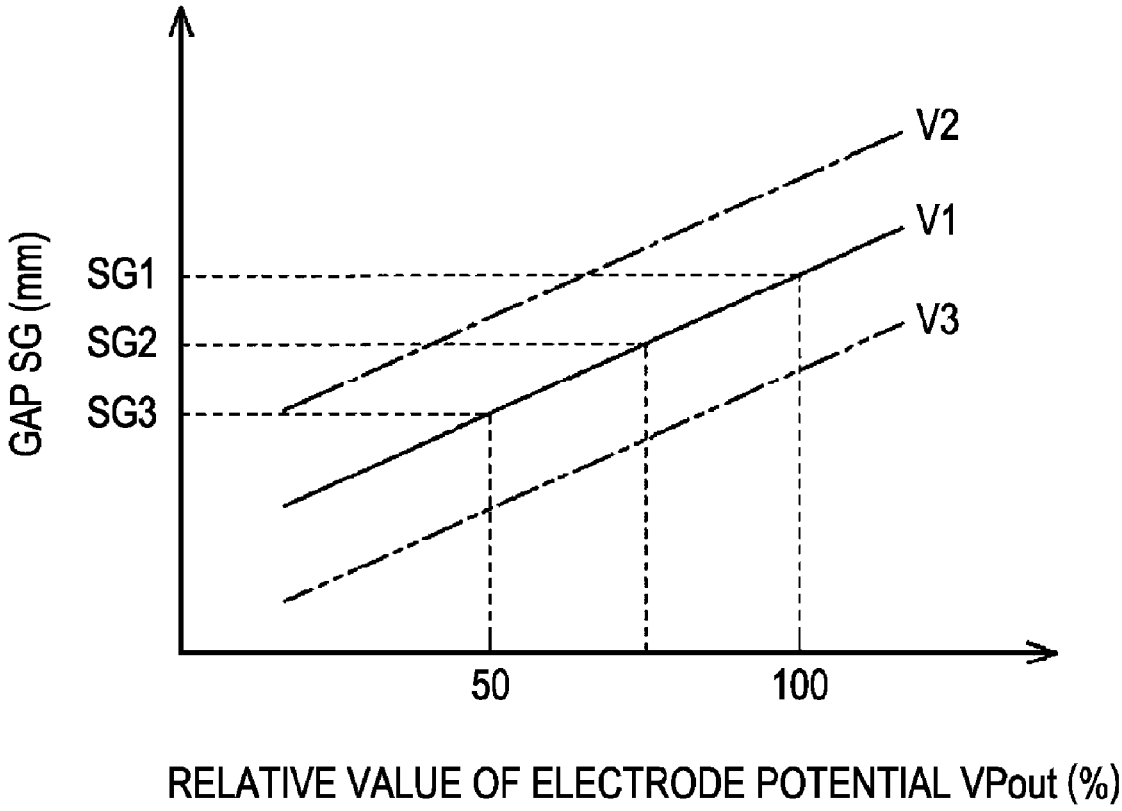
FIG. 11 is a graph illustrating a relationship between an electrode potential relative value VPout and a gap.

(Modification 3) In the above-mentioned embodiment, an adjustment method in which the gap is changed stepwise is adopted. However, the adjustment method continuously changing the gap according to the electrode potential relative value VPout can be adopted. For example, in the structure in which the gap can be continuously adjusted as exemplified in the modification 1 and the modification 2, a map or table data illustrated in a graph of FIG. 11 and showing the correspondence relationship between the electrode potential relative value VPout (%) and the gap SG is stored in the memory. Accordingly, the electrode potential relative value VPout is obtained on the basis of the electrode potential Vout (initial potential) at the time of nozzle inspection, the gap SG according to the electrode potential relative value VPout at that time is acquired with reference to the map or the table stored in the memory, and the motor (for example, the CR motor 18 or an electric motor 82) is controllably driven so that the cap 27 is placed at the position at which the gap SG becomes the acquired gap. Accordingly, the gap is continuously adjusted to the gap SG according to the electrode potential relative value VPout. In an example of FIG. 11, a structure in which the inspection voltage (application voltage) changes may be adopted. Therefore, as for the initial application voltage Vo, for example, if the electrode potential relative value VPout becomes the lower limit of the threshold value (for example, 50%) or lower, the initial application voltage changes to an application voltage V2 (>V1) which is one-step higher, and the gap is adjusted to the gap SG according to the electrode potential relative value VPout under the condition of the application voltage V2. Further, as for the initial application voltage V1, if the electrode potential relative value VPout exceeds the upper limit of the threshold value (for example, 100%), the application voltage changes to the one-step lower application voltage V3 (<V1), and the gap is adjusted to the gap SG according to the electrode potential relative value VPout under the condition of the application voltage V3. In this manner, since the application voltage changes in a manner such that the electrode potential relative value VPout (%) becomes to be within an appropriate range (for example, 50 to 100%) the amplitude of the detection wave becomes to be within the appropriate range by changing the application voltage in the case in which it is impossible to deal with the situation only by the adjustment of the gap, and therefore the nozzle inspection can be correctly performed. In the above-mentioned embodiment, a function of changing the application voltage may be added. In this case, according to the range to which the electrode potential relative value VPout (%) belongs, any of the gaps SG1, SG2, and SG3 is selected. Further, the control device 41 performing the processing of changing the application voltage corresponds to the application voltage adjustment unit.

Figure 12:
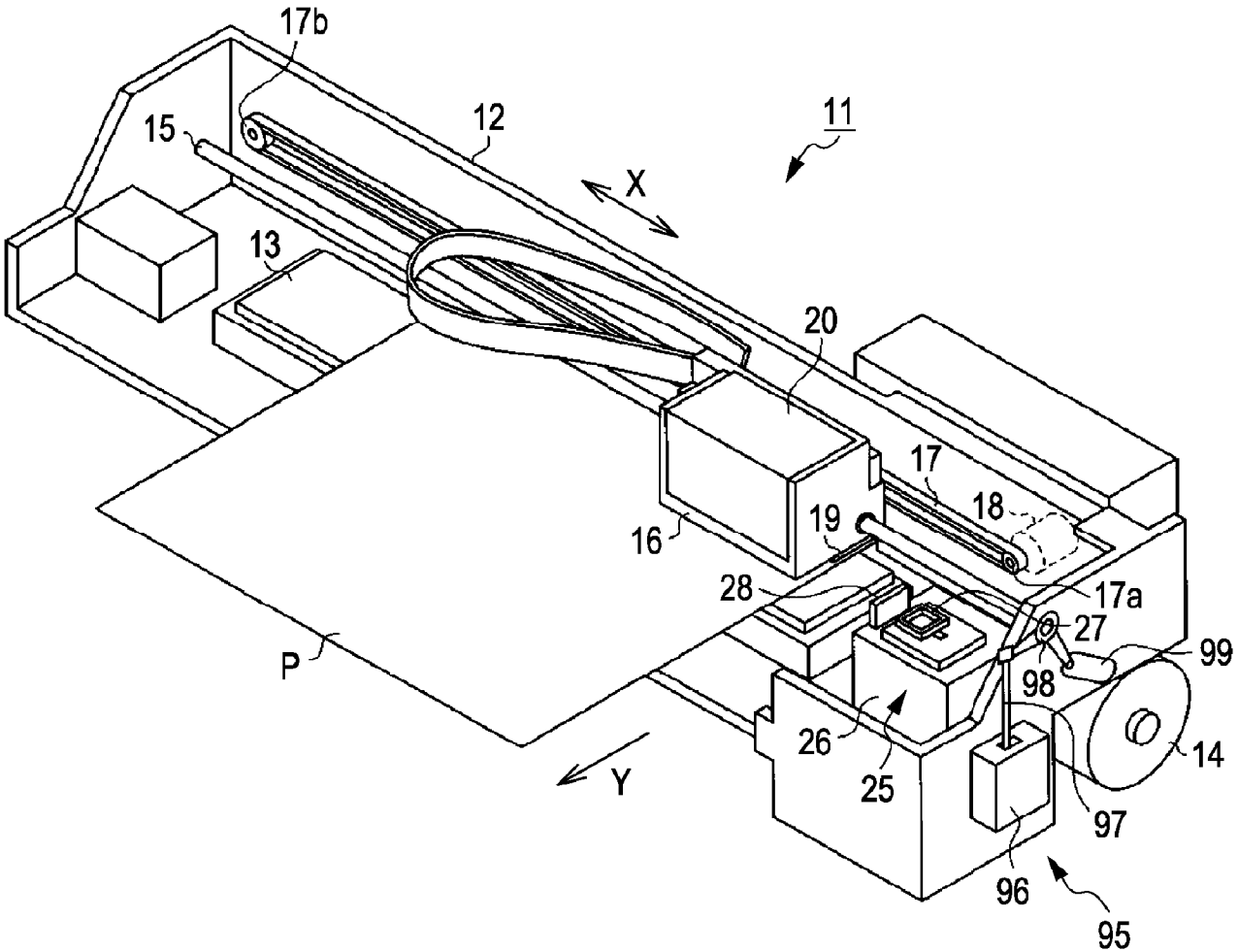
FIG. 12 is a schematic perspective view illustrating a printer according to a modification.

(Modification 4) The adjustment of the gap may be performed by a method of elevating and lowering the recording head. For example, a platen gap adjusting device is used. That is, as shown in FIG. 12, the printer 11 is provided with a platen gap adjustment device for adjusting a platen gap which is a gap between the recording head and a platen by elevating or lowering the carriage 16 by performing elevating or lowering motion with respect to a guide shaft 15. The platen gap adjustment device is provided with an elevating and lowering device 95 which elevates and lowers the guide shaft 15 on one side surface of the main body frame 12 of the printer 11. The elevating and lowering device 95 includes a direct-driving actuator 96, a rotor 98 having two arms and pivotably supported on the side surface of the main body frame 12, and a manipulation lever 99 having one end, engaging with a leading end of an arm of a rotator 98 of which a leading end of the other arm is connected to a leading end of a driving rod 97 of the direct-driving actuator 96, and the other end pivotably supported via an eccentric mechanism (not shown) on the side surface of the main body frame 12. The manipulation lever 99 pivots about a base end portion by moving up and down the driving rod 97 as the direct-driving actuator 96 is driven. The middle shaft penetrating through the guide shaft 15 having a pipe shape is supported by the base end portion of the manipulation lever 99 in the state in which the middle shaft is eccentric in the guide shaft 15. When the manipulation lever 99 pivots, the guide shaft 15 eccentrically pivots with respect to the middle shaft and therefore the guide shaft 15 is elevated or lowered. Accordingly, if the drive rod 97 is directly driven up as the actuator 96 starts, the guide shaft 15 is raised and therefore the recording head 19 is also moved up. On the other hand, if the actuator 96 starts and the drive rod 97 is directly driven down, the guide shaft 15 is lowered and therefore the recording head 19 is moved down along the guide shaft. Accordingly, when the electrode potential relative value VPout becomes below the threshold value VP1, the gap SG is adjusted to be smaller by controlling an elevating and lowering stroke of the drive rod 97 of the actuator 96.

(Modification 5) The method of detecting the non-inspectable state in which the required nozzle inspection precision cannot be obtained due to the ink deposed on the detection electrode 47 may not be limited to a method of detecting the electrode potential. For example, in the case in which the number of time of detection of the defective nozzle exceeds the predetermined threshold value, it may be determined such that the state is abnormal. In the case in which the amplitude of the detection wave is decreased to the extent that it is impossible to perform a correct nozzle inspection, it is determined such that the entire nozzles are defective nozzles. By the use of this method, it is determined such that it is non-inspectiable when the half or more number of nozzles is defective, that is, the number of time of detection of the defective nozzle exceeds the threshold value. Further, the structure in which the gap is adjusted to be become smaller in this manner may be adopted.

(Modification 6) It may be a structure in which it is determined whether the maximum value of detection values (that is, the detection value of the normal nozzle) according to the amplitude of the detection wave obtained by performing the discharge of ink droplets with respect to a plurality of nozzles exceeds the threshold value needed to perform the normal inspection, if the detection value is below the threshold value, it is determined such that the inspection is impossible, and therefore the gap is adjusted to be smaller.

(Modification 7) In this modification, since whether the electrode potential Vout is in the appropriate range for each of the gaps SG1, SG2, and SG3, the upper limit of the threshold value may be set in addition to the lower limit of the threshold value. According to this structure, the previous gap stored in the memory is adopted at the next time of nozzle inspection after decreasing the gap SG and finishing the nozzle inspection. Then, in the case in which the ink layer deposited on the detection electrode 47 by the next time of nozzle inspection is removed and therefore the electrode potential Vout exceeds the upper limit of the threshold value, the gap is adjusted to a width, and this adjustment is performed until the electrode potential Vout falls into the appropriate range. Since the gap obtained in the gap determination processing in the previous time of the nozzle inspection is adopted in the next time of nozzle inspection, it is possible to decrease the number of times of gap adjustment without the need of readjusting the gap while maintaining the initial value in every time of nozzle inspection. The invention may be configured in a manner such that a nonvolatile memory may be used as the memory and the gap SG used in the previous time is read out from the nonvolatile memory and then used when the printer 11 is turned on.

(Modification 8) The gap adjustment is not limited to a structure performing before the start of inspection. For example, the gap adjustment may be performed in the middle of inspection or after the inspection. For example, after the gap adjustment is performed according to the need on the basis of the electrode potential Vout before the start of the inspection, the inspection begins. Further, in the middle of the inspection, the determination of whether it is non-inspectable is performed on the basis of the electrode potential Vout again. If it is necessary, the gap adjustment is performed. According to this structure, ink droplets discharged during the nozzle inspection are gradually deposited on the detection electrode 47 and therefore there is the possibility that it falls into the non-inspectable state at last in the middle of inspection. However, since the gap is adjusted during the inspection if it is necessary, it is possible to correctly perform the nozzle inspection under the condition of the inspectable state from the beginning to the ending of the nozzle inspection. For example, if the number of inspection nozzles is 1000, the inspection gap determination processing is performed in the form of interruption processing whenever inspections of a predetermined number of nozzles in a range from 100 to 500 nozzles end.

(Modification 9) The detection unit is structured to be able to detect the non-inspectable state in which the amplitude of the detection wave is too large to perform inspection. In the case in which the non-inspectable state is detected, the gap SG may be adjusted to be larger until the amplitude of the detection wave is decreased so as to be in an appropriate range.

(Modification 10) To accomplish highly precise inspection, in addition to the gap adjusting function, a function of increasing the number of ink droplets for each nozzle inspection may be adopted.

(Modification 11) The invention is not limited to a structure in which the inspection is performed nozzle by nozzle in order. For example, the invention may adopt a structure in which ink droplets are discharged from a plurality of nozzles at a time, and it is detected whether at least one of the nozzles of the plurality of nozzles is defective on the basis of the detection value according to the change of intensity of the electric field at the time of ink discharge. For example, in the case in which ink droplets are discharged from N nozzles at a time (however, the discharge timing of the nozzles may deviate somewhat) it is possible to practically reduce the number of times of nozzle inspection of the case adopting the structure in the above-mentioned embodiment to 1/N.

(Modification 12) The fluid storage portion is not limited to the cap but may be a flushing box.

(Modification 13) In the above-mentioned embodiment, the nozzle inspection device is applied to an ink jet recording-type serial printer, but may also be applied to an ink jet recording-type line printer.

(Modification 14) The movement direction of the fluid storage portion is not limited to the elevating and lowering. For example, at least one of the discharge unit and the detection electrode may be moved in a horizontal direction so that they approach each other or depart from each other.

(Modification 15) In the above-mentioned embodiment, the fluid discharge apparatus is concreted into the ink jet recording device but is not limited thereto. That is, the fluid discharge apparatus can be concreted into a fluid discharge apparatus which discharges fluid other than ink (including a fluid, a fluid material in which particles of a functional material is dispersed in or mixed with a fluid, a liquid material, such as gel, and a solid which can be discharged as a fluid). For example, the fluid discharge apparatus may be a liquid material discharge apparatus discharging a liquid material in which an electrode material or a color material (pixel material) used to manufacture a fluid crystal display, an electroluminance (EL) display, and a surface light-emitting display is dispersed or dissolved, a liquid discharge apparatus discharging a bio-organic material used to manufacture a biochip, and a liquid discharge apparatus discharging a liquid used as a sample used as a precision pipette. Further, the fluid discharge apparatus may be a liquid discharge apparatus discharging a lubricant to a precision machine, such as a clock and a camera in a pinpoint manner, a liquid discharge apparatus discharging a transparent resin solution, such as ultraviolet ray curable resin to a substrate in order to form fine hemispherical lenses (optical lenses) used in optical communication element, a liquid discharge apparatus discharging an etching solution, such as an acid and an alkali for etching a substrate, a fluid material discharge apparatus discharging a fluid material such as gel (for example, physical gel), or a granular material discharge apparatus, (for example, a toner jet recording apparatus) discharging a solid, for example, powder (granular material), such as toner. Accordingly, the invention can be applied to any of these fluid discharge apparatuses. In this specification, the term "fluid" is a concept which does not contain a fluid composed of only gas but includes, for example, a liquid (including an inorganic solvent, an organic solvent, a solution, a liquid-phase resin, and a liquid-phase metal (fused metal)), and a liquid material, a fluid material, and a granular material (granule, powder). Further, the above substrate, the precision machine, etc become the target.

What is claimed is:

1. A nozzle inspection device for inspecting presence of a defective nozzle in a fluid discharge apparatus including a discharge unit having nozzles which can discharge fluid to a target, comprising:

an inspection electrode placed apart from the discharge unit with a gap therebetween;

an inspection unit for inspecting the presence of the defective nozzle on the basis of a detection value obtained by detecting a change of an intensity of an electric field which is attributable to a discharge of the fluid by discharging the fluid with respect to the inspection electrode from the discharge unit in a state in which the electric field is generated by application of a voltage between the discharge unit and the inspection electrode;

a detection unit for detecting whether the inspection unit is in a non-inspectable state, wherein the detection unit includes an electrode potential detection unit which detects a potential of the inspection electrode in a non-discharge state in which the fluid is not discharged before the inspection and a determination unit which determines that the inspection unit is in an inspectable state when the detection value detected by the electrode potential detection unit exceeds a predetermined threshold value and that the detection unit is in the non-inspectable state when the detection value is equal to or is less than the threshold value; and a gap adjustment unit for adjusting the gap by transferring either the discharge unit or the inspection electrode in a case in which the inspection unit is in the non-inspectable state, wherein the inspection unit inspects the presence of the defective nozzle after performing gap adjustment by using the gap adjustment unit.

2. The nozzle inspection device in a fluid discharge apparatus according to claim 1, wherein the gap adjustment unit adjusts the gap to be a width according to the detection value of the electrode potential detection unit.

3. The nozzle inspection device in a fluid discharge apparatus according to claim 2, further comprising an application voltage adjustment unit which adjusts an application voltage applied between the discharge unit and the inspection electrode, wherein the application voltage adjustment unit changes the application voltage so that the detection value of the electrode potential detection unit comes in a predetermined range when the detection value of the electrode potential detection unit is out of the predetermined range, and wherein detection under the application voltage, which is changed by the detection unit, and gap adjustment, performed by the gap adjustment unit, are performed after the change of the application voltage.

4. The nozzle inspection device in a fluid discharge apparatus according to claim 3, wherein the discharge unit is provided in a carriage which is movable by power of a carriage drive power source along a transfer pathway which causes the discharge unit to perform fluid discharge processing, wherein the inspection electrode is provided in a fluid storage portion which is capable of storing fluid discharged from nozzles of the discharge unit, wherein the nozzle inspection device further includes a transfer mechanism which transfers the fluid storage portion in a direction in which the storage portion can approach and depart from the discharge unit, in which the transfer mechanism includes an urging unit which urges the fluid storage portion in a direction in which the fluid storage portion departs the discharge unit, a slider which supports the fluid storage portion and has a manipulation portion which is to be engaged while the carriage is transferred toward an inspection position where the inspection by the inspection unit is performed, and a guide unit which guides the slider in a direction in which the fluid storage portion approaches the discharge unit by pressing the manipulation portion against urging force of the urging unit while the carriage is transferred to the inspection position and guides the slider in a direction in which the fluid storage portion departs the discharge unit by the urging force of the urging unit while the carriage departs the inspection position by eliminating a pressure applied to the manipulation portion, wherein the nozzle inspection device still further includes a locking unit which is driven by power of a locking power source so that the carriage is placed at a locking position at which the carriage is maintained, resisting against recovery force of the urging unit and at a restoring position at which the carriage cannot be engaged, and wherein the gap adjustment unit includes a control unit which performs a carriage transfer control for transferring the carriage to the inspection position according to the gap which is adjusted, and a locking position control for adjusting the locking position by the locking unit in order to position the carriage at the inspection position.

5. A nozzle inspection method in a fluid discharge apparatus including a discharge unit having nozzles which can discharge fluid to a target, an inspection electrode placed apart from the discharge unit with a gap therebetween, and an inspection unit which inspects presence of a defective nozzle on the basis of a detection value obtained by detecting a change of an intensity of an electric field when fluid is discharged by discharging the fluid to the inspection electrode from the discharge unit in a state in which an electric field is generated by applying a voltage between the discharge unit and the inspection electrode, the nozzle inspection method comprising:

a detection step of detecting that the inspection unit is in a non-inspectable state, wherein the detection unit includes an electrode potential detection unit which detects a potential of the inspection electrode in a non-discharge state in which the fluid is not discharged before the inspection and a determination unit which determines that the inspection unit is in an inspectable state when the detection value detected by the electrode potential detection unit exceeds a predetermined threshold value and that the detection unit is in the non-inspectable state when the detection value is equal to or is less than the threshold value a gap adjustment step of adjusting the gap to come in a range in which the inspection unit is in the inspectable state by transferring either the discharge unit or the inspection electrode in a case in which it is detected such that the inspection unit is in the non-inspectable state; and an inspection step of discharging fluid to the inspection electrode from the discharge unit after the gap adjustment step and inspecting presence of the defective nozzle on the basis of the detection value obtained by detecting the change of the intensity of the electric field which is attributable to a discharge of the fluid.

* * * * *